US007647663B2

(12) United States Patent
Kim et al.

(10) Patent No.: US 7,647,663 B2
(45) Date of Patent: Jan. 19, 2010

(54) COMBINATION LAUNDRY DEVICE AND METHOD THEREOF

(75) Inventors: Young Soo Kim, Changwon-si (KR); Soung Bong Choi, Changwon-si (KR); Byung Hwan Ahn, Gimhae-si (KR); Deug Hee Lee, Gimhae-si (KR); Hung Myong Cho, Gyeongsangnam-do (KR)

(73) Assignee: LG Electronics Inc, Seoul (KR)

( * ) Notice: Subject to any disclaimer, the term of this patent is extended or adjusted under 35 U.S.C. 154(b) by 769 days.

(21) Appl. No.: 11/296,863

(22) Filed: Dec. 8, 2005

(65) Prior Publication Data

US 2006/0150689 A1 Jul. 13, 2006

(30) Foreign Application Priority Data

Dec. 9, 2004 (KR) ..... 10-2004-0103480

(51) Int. Cl.
*D06F 33/02* (2006.01)

(52) U.S. Cl. ..... 8/159; 68/3 R; 68/12.02; 68/20

(58) Field of Classification Search ..... 134/184, 134/198; 8/158; 68/15, 3 R, 12.02, 20
See application file for complete search history.

(56) References Cited

U.S. PATENT DOCUMENTS

| | | | | |
|---|---|---|---|---|
| 3,102,796 | A * | 9/1963 | Erickson | 34/75 |
| 3,173,767 | A * | 3/1965 | Perloff | 34/82 |
| 3,242,584 | A * | 3/1966 | Jacobs | 34/448 |
| 3,402,477 | A * | 9/1968 | Hubbard | 34/543 |
| 3,417,481 | A | 12/1968 | Rumsey | |
| 3,555,701 | A * | 1/1971 | Hubbard | 34/602 |
| 3,673,701 | A | 7/1972 | Albertson | |
| 3,866,333 | A | 2/1975 | Surakahanian et al. | |
| 3,921,308 | A | 11/1975 | Freze | |
| 4,103,433 | A | 8/1978 | Taylor | |
| 4,189,341 | A | 2/1980 | McPherson | |
| 4,204,339 | A | 5/1980 | Muller | |
| 4,207,683 | A * | 6/1980 | Horton | 34/60 |
| 4,819,341 | A | 4/1989 | Gayso | |
| 5,546,678 | A | 8/1996 | Dhaemers | |
| 5,644,936 | A * | 7/1997 | Yasutake et al. | 68/12.02 |
| 5,715,555 | A * | 2/1998 | Reber et al. | 8/158 |
| 6,463,940 | B1 | 10/2002 | Thomas et al. | |
| 6,629,439 | B2 * | 10/2003 | Wobkemeier | 68/12.02 |

(Continued)

FOREIGN PATENT DOCUMENTS

| | | |
|---|---|---|
| DE | 3204718 | 9/1982 |

(Continued)

OTHER PUBLICATIONS

European Patent Office 1 225 267 Jan. 2001.*

*Primary Examiner*—Frankie L Stinson
(74) *Attorney, Agent, or Firm*—McKenna Long & Aldridge LLP

(57) ABSTRACT

A combination laundry device and a method thereof are disclosed. The present invention relates to a combination laundry device that can interchange information between two laundry mechanisms, and that can automatically set operation conditions for a washing and a drying and/or a refreshing cycle based on information from each information tag attached on the laundry without a user's inputting additional conditions.

18 Claims, 6 Drawing Sheets

U.S. PATENT DOCUMENTS

| | | | | |
|---|---|---|---|---|
| 6,796,055 | B2 | 9/2004 | Baltes | |
| 6,868,621 | B1 | 3/2005 | Grimm et al. | |
| 6,904,703 | B2 | 6/2005 | Naganawa et al. | |
| 6,928,752 | B2 * | 8/2005 | Johnson et al. | 34/595 |
| 7,191,546 | B2 | 3/2007 | Maruca | |
| 7,481,178 | B2 * | 1/2009 | Laackmann | 116/216 |
| 2001/0049846 | A1 * | 12/2001 | Guzzi et al. | 8/158 |
| 2004/0088075 | A1 | 5/2004 | Batcher | |
| 2004/0134237 | A1 * | 7/2004 | Sunshine et al. | 68/3 R |
| 2004/0154194 | A1 | 8/2004 | Prows | |
| 2004/0194339 | A1 | 10/2004 | Johnson et al. | |
| 2007/0169279 | A1 | 7/2007 | Park et al. | |

FOREIGN PATENT DOCUMENTS

| | | | |
|---|---|---|---|
| DE | 197 43 508 | * | 4/1999 |
| DE | 19810907 | | 9/1999 |
| DE | 19917206 | | 10/2000 |
| DE | 10-2005-053702 | | 6/2006 |
| EP | 1441059 | | 7/2004 |
| GB | 2 026 147 | | 1/1980 |
| JP | 63-082700 | * | 4/1988 |
| JP | 04-126198 | | 4/1992 |
| KR | 20-0243057 | | 10/2001 |
| WO | WO 97/10376 | | 3/1997 |
| WO | WO 2006/009375 A2 | | 1/2006 |
| WO | WO 2006/025650 A2 | | 3/2006 |
| WO | WO 2006/028326 A2 | | 3/2006 |

* cited by examiner

COMBINATION LAUNDRY DEVICE AND METHOD THEREOF

This application claims the benefit of the Patent Korean Application No. P2004-103480, filed on Dec. 9, 2004, which is hereby incorporated by reference as if fully set forth herein.

BACKGROUND OF THE INVENTION

1. Field of the Invention

The present invention relates to a combination laundry device combining two related laundry mechanisms.

2. Discussion of the Related Art

In general, laundry devices including washing machines and dryers are electric home appliances which can wash or dry cloth items, cloths and beddings (hereinafter, 'the laundry'). A dryer of the laundry devices used in a house usually dries a small amount of the laundry.

That is, the dryer receives the laundry washed by the washing machine, and dries the laundry by supplying hot air.

However, since conventional related art washing machines and dryers are separate and different from each other, a user who tries to wash and dry the laundry may have an inconvenience of washing the laundry by controlling the washing machine, followed by drying the laundry by controlling the dryer.

Thus, recently there have been provided accordingly a new type of a combination dryer providing a dryer and an auxiliary cabinet dryer, which controls the dryer and the cabinet dryer at the same time by sharing one controller. For example, US Laid-open Patent Application No. 2004-0194339 A1 or US Laid-open Patent Application No. 2004-0154194.

However, the combination dryer described above has an inconvenience that it performs only a drying cycle and keeping of the laundry, not a washing cycle.

That is, since an auxiliary washing machine should be provided for washing the laundry, the user should purchase a washing machine and a combination dryer separately. Thus, it is difficult to secure an installation space, and also the user should control each controller.

That is because the two mechanisms fail to share information. Thereby, complete automation of washing processes is not accomplished, because operation control between the two mechanisms is performed separately.

SUMMARY OF THE INVENTION

Accordingly, the present invention is directed to a combination laundry device and a method thereof that substantially obviates one or more problems due to limitations and disadvantages of the related art.

An object of the present invention is to provide a new type of a combination laundry device that can interchange information between two related laundry mechanisms, and that can automatically set operation conditions for a washing and a drying and/or a refreshing cycle based on information from each information tag attached on the laundry without the user's inputting additional conditions.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a combination laundry device comprises a washing and/or drying part having a drum for performing a washing and a drying cycle for the laundry each having an information tag memorizing information relating to washing and/or drying conditions; a cabinet dryer combined with the washing and/or drying part for performing a drying or a refreshing cycle, or keeping the laundry therein; a reading part for acquiring information memorized in each information tag of the laundry; and a controller provided in at least one of the washing and/or drying part and the cabinet dryer for acquiring information of the entire laundry loaded into the drum from said reading part, and for controlling the washing and/or drying part and the cabinet dryer by selectively setting operation conditions of the washing and/or drying part and the cabinet dryer.

At that time, the information tag is a RFID tag and the reading part is a RFID reader which receives information from the RFID tag, interchanging signals with the RFID tag or recording new information in the RFID tag.

Also, a hot air generating part is further provided in at least one of the washing and/or drying part and the cabinet dryer for generating hot air to supply the hot air into the washing and/or drying part and the cabinet dryer.

To achieve these objects and other advantages and in accordance with the purpose of the invention, as embodied and broadly described herein, a method of a combination laundry device comprising: a first step of acquiring information relating to washing and/or drying conditions from each information tag of the laundry loaded into a drum of a washing and/or drying part; a second step of setting each process of each cycle for washing and/or drying the laundry based on the acquired information; and a third step of performing a washing and/or a drying cycle based on an order of the set processes by controlling the washing and/or drying part, and/or the cabinet dryer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
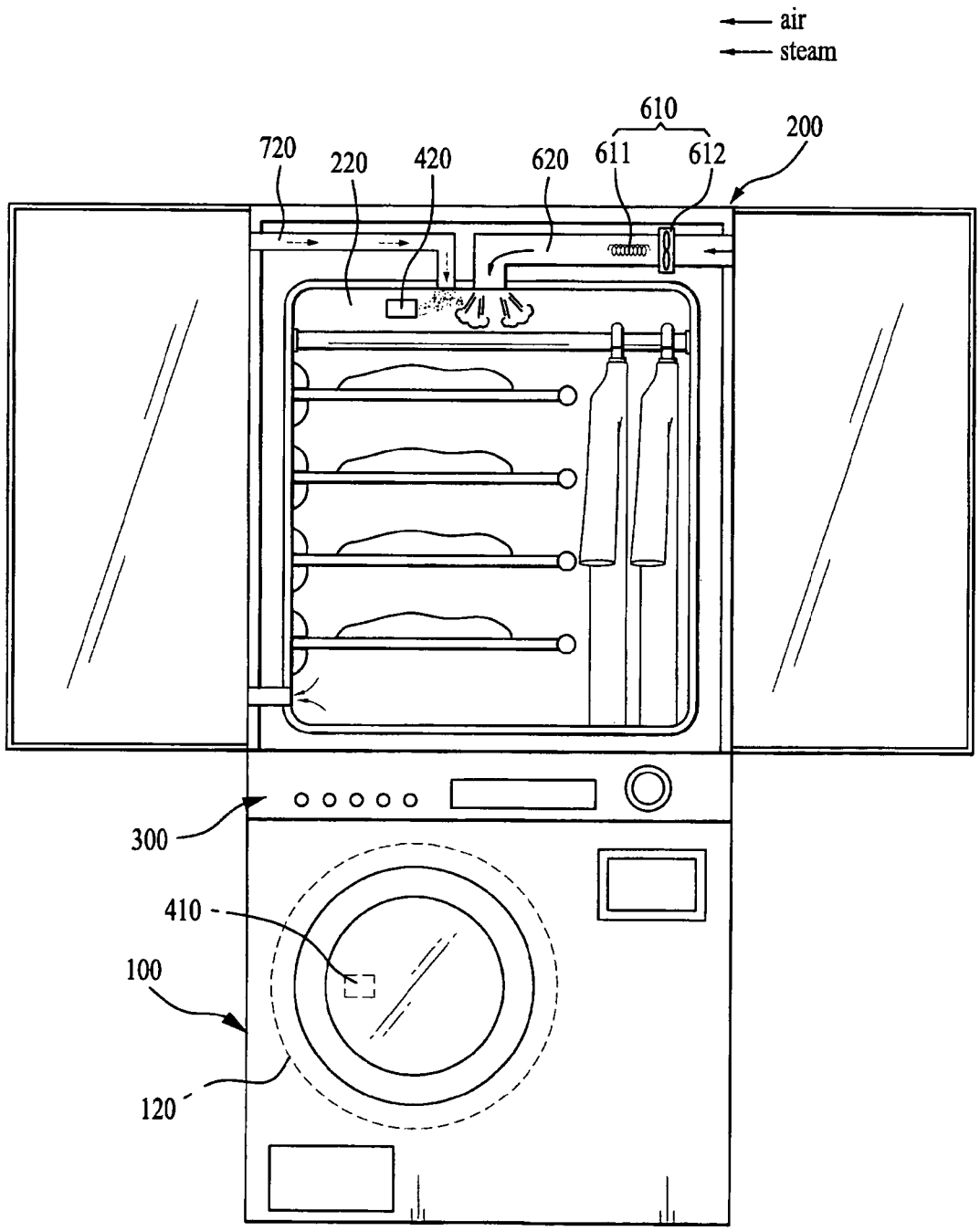
FIG. 1 is a diagram schematically illustrating an exterior of a combination laundry device according to a first embodiment of the present invention.
Figure 2:
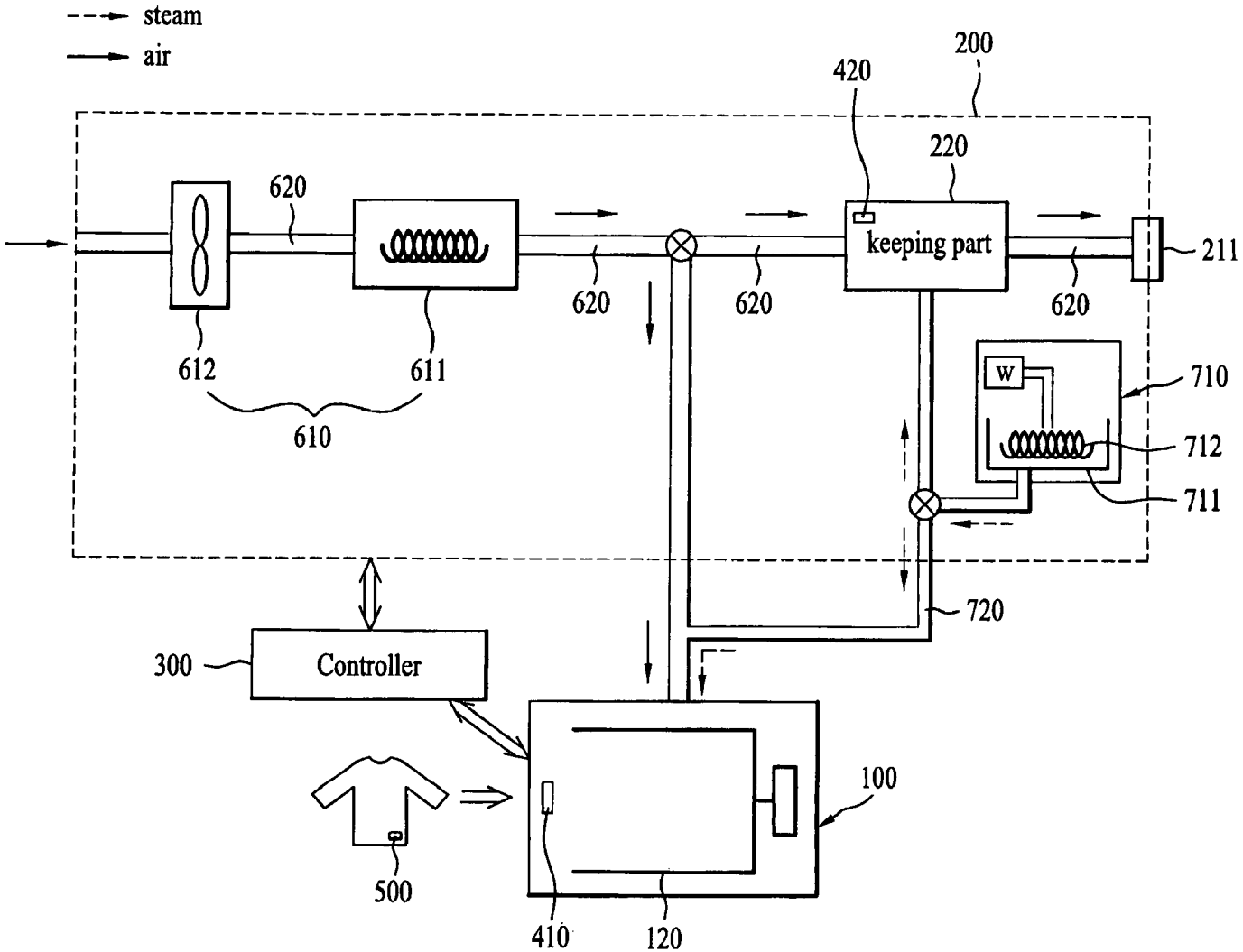
FIG. 2 is a block diagram schematically illustrating the combination laundry device according to the first embodiment of the present invention.

As shown in FIGS. 1 to 2, a combination laundry device according to a first embodiment of the present invention includes a washing and/or drying part 100, a cabinet dryer 200, a reading part 410 and a controller 300.

Each of the above configurations will be described in detail as follows.

First, the washing and/or drying part 100 will be described.

The washing and/or drying part 100 performs a washing and/or a drying cycle(s), and includes a drum 120 capable of rotating and agitating.

The first embodiment of the present invention presents that the washing and/or drying part 100 is a washing machine performing only a washing cycle.

Next, the cabinet dryer 200 will be described.

The cabinet dryer 200 is mounted on a top of the washing and/or drying part 100 for drying the laundry washed in the washing and/or drying part 100, keeping the laundry for a while and refreshing the laundry.

The cabinet dryer 200 includes a keeping part 220 for keeping lots of the laundry therein.

The keeping part 220 is space within the cabinet dryer 200, which keeps the laundry.

Next, the reading part 410 will be described.

The reading part 410 is provided in the washing and/or drying part 100 and employed for acquiring information from each information tag 500 of the laundry loaded into the drum 120.

The information tag 500 attached on each of the laundry is a tag capable of transmitting information through sending/receiving signals with the reading part 410 as well as memorizing new information. Each information tag 500 has information, relating to washing and/or drying conditions of each laundry, memorized thereon.

Especially, the information tag 500 is a radio-frequency-identification (RFID) tag capable of recording additional information. Preferably, the reading part 410 is a RFID reader, which interchanges signals with the RFID tag and receives information from the RFID tag or records new information in the RFID tag.

Alternatively, the information tag 500 may be formed as a bar code, and the reading part 410 may be a bar code reader as well as various structures capable of interchanging information by a non-contact system.

Also, the washing related information memorized in the information tag on each laundry includes at least one of a washing temperature, a spinning speed, a drying temperature and a drying time period.

Preferably, the reading part 410 is provided in a portion of the washing and/or drying part 100, where the laundry is loaded.

That is for helping the reading part 410 to acquire information of the laundry, while loading the laundry into the washing and/or drying part 100.

Alternatively, the reading part 410 is enabled to acquire information collectively after completing the introduction of the laundry into the drum 120. In that case also, the reading part 410 may be provided in a laundry-loading portion.

Next, the controller 300 will be described.

The controller 300 acquires information of the laundry loaded into the drum 120 from the reading part 410, and sets, based on the kind of the laundry, the washing and/or drying part 100's operation and the cabinet dryer 200's operation variously to perform a washing and/or drying or, refreshing cycle.

At that time, the controller 300 may be provided only in the washing and/or drying part 100, only in the cabinet dryer 200, or in the washing and/or drying part 100 and the cabinet dryer 200.

The first embodiment of the present invention embodies that the controller 300 is provided only in the cabinet dryer 200.

According to the embodiments of the present invention, a hot air generating part 610 is further provided in a combination laundry device for making a drying cycle possible.

The hot air generating part 610 will be described.

The hot air generating part 610 generates high temperature hot air and supplies the hot air into the drum 120 of the washing and/or drying part 100 and the keeping part 220 of the cabinet dryer 200.

The hot air generating part 610 may be provided at least one of the washing and/or drying part 100 and the cabinet dryer 200, and the first embodiment of the present invention embodies that the hot air generating part 610 is provided only in the cabinet dryer 200.

Also, the hot air generating part 610 is connected with the drum 120 of the washing and/or drying part 100 and/or the keeping part 220 of the cabinet dryer 200 by a hot air supplying pipe 620.

The hot air generating part 610 includes a drying heater 611 for heating air flowing in the hot air supplying pipe 620. Preferably, the hot air generating part 610 further includes a fan 612 for forcibly ventilating air within the hot air supplying pipe 620.

On the other hand, the combination laundry device according to the present invention further includes a steam generating part 710 for making a refreshing cycle possible.

The steam generating part 710 will be described.

The steam generating part 710 generates steam and supplies the steam into the drum 120 of the drum washing part 100, and/or the keeping part 220 of the cabinet dryer 200.

The steam generating part 710 is provided in at least one of the washing and/or drying part 100 and the cabinet dryer 200, and the first embodiment of the present invention embodies that the steam generating part 710 is provided only in the cabinet dryer 200.

At that time, the steam generating part 710 is connected with the washing and/or drying part 100, and/or the cabinet dryer 200 by a steam supplying pipe 720.

The steam generating part 710 includes a heat radiating part 711 having space for temporarily storing water, and a heating element 712 provided within the heat radiating part 711 for heating and evaporating the water into steam.

The heat radiating part 711 may receive water from a detachable water chamber (not shown), and may be connected with a water pipe (not shown) supplying washing water for receiving the water, and also may receive water such as condensed water generated in the washing and/or drying part 100.

On the other hand, the embodiments of the present invention embodies that an auxiliary reading part 420 is further provided in the cabinet dryer 200.

The auxiliary reading part 420 acquires information memorized in each tag 500 of the laundry loaded into the keeping part 220 of the cabinet dryer 200, and then supplies the information to the controller 300.

Figure 3:
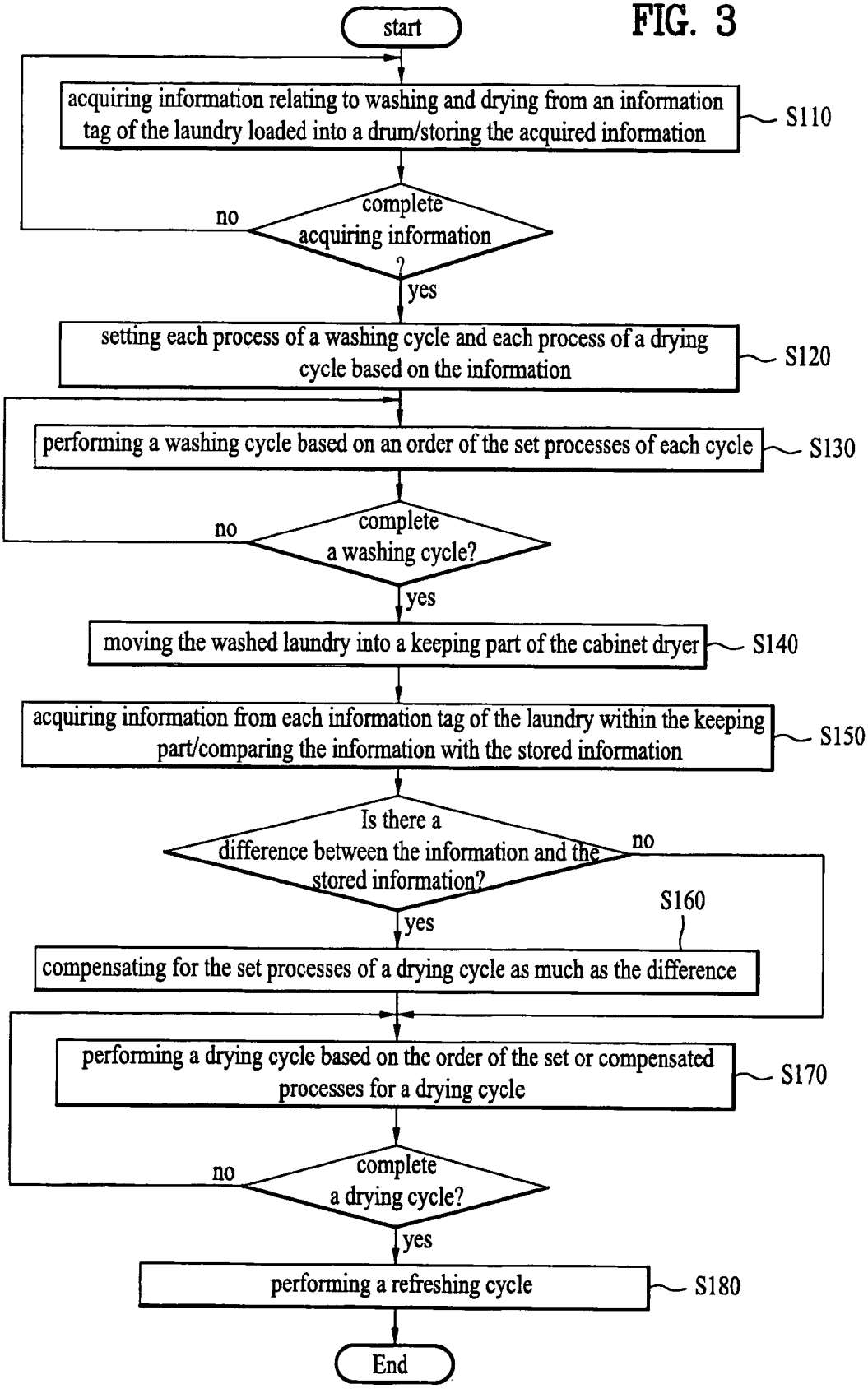
FIG. 3 is a flow chart schematically illustrating operation control processes of the combination laundry device according to the first embodiment of the present invention.

Referring to a flow chart of FIG. 3, an operation controlling method of the combination laundry device will be described.

First, the controller 300 controls a reading part 410 so that information relating to washing and drying conditions on the laundry may be acquired from each tag 500 of the laundry within a drum 120, and stores the acquired information (S110).

The reading part 410 communicates with each information tag 500 of the laundry for acquiring various pieces of information stored in each tag 500.

The information relating to washing and drying conditions includes at least one of a kind of the laundry, a quantity of each kind of the laundry, a preferred washing temperature, a dehydrating speed, a kind of detergent, a washing water level, a drying temperature and a drying time period.

Although not embodied as an embodiment, the information acquired by the reading part 410 may further include directions for a washing and a drying cycles, in addition to the above information.

Next, based on the information acquired through the reading part 410, the controller 300 sets up a washing cycle for the washing and/or drying part 100, and a drying cycle for the cabinet dryer 200 (S120).

Each cycle is set up based on at least one classification of a washing time period, a washing temperature, a kind of detergent, a hydrating speed, a drying temperature and a drying time period.

For example, once the kind of the laundry loaded into the drum 120 is identified as wool, a washing temperature is set up between 30~50° C. in a stat of warmth. The washing time period is set up longer than the other kinds of the laundries, as well as having lots of pauses. The detergent is set up as detergent for wool only and the dehydrating speed is set up slow. The drying is set up at a low temperature for a long time period.

Of course, each time period of each cycle and each washing water level should be set up variously, based on the quantity of the laundry.

Next, once each cycle operation is set by the above processes, the controller 300 controls the washing and/or drying part 100 based on the set processes of cycles to wash the laundry loaded into the drum washing machine 100 (S130).

Once the washing cycle is completed, the washed laundry is taken out of the washing and/or drying part 100 and moved into the keeping part 220 of the cabinet dryer 200 (S140).

At that time, the controller 300 controls the auxiliary reading part 420 and acquires various pieces of information from each tag 500 of the laundry. Hence, the controller 300 compares the information acquired by the auxiliary reading part 420 and the one initially acquired by the reading part 410 (S150).

The comparison is for identifying if all of the washed laundry is loaded into the keeping part 220.

That is, it is identified if all of the laundry initially loaded into the washing and/or drying part 100 is moved into the keeping part 220 of the cabinet dryer 200.

If there is a difference between the first laundry of the washing and/or drying part 100 and the laundry of the keeping part 220 of the cabinet dryer 200, the controller 300 compensates for the difference (S160).

For example, once some of the laundry initially loaded into the washing and/or drying part 100 is loaded into the keeping part 220, the controller 300 makes up for values of a drying temperature or a drying time period as much as the lessened values of the laundry quantities and laundry qualities (or laundry kinds).

Preferably, the controller 300 further identifies information of the laundry within the keeping part 220, and makes up for the difference to help a drying and a refreshing cycle based on the information.

Hence, the controller 300 performs a drying cycle for the laundry within the keeping part 220 based on the compensating operation process (S170).

When it is identified that all of the laundry initially loaded into the washing and/or drying part 100 is moved into the keeping part 220, based on an order of an initially set drying cycle, a drying cycle is performed without compensation for a drying cycle.

The drying cycle is accomplished by controlling the hot air generating part 610.

That is, the drying heater 611 is operated by the controller 300 for heating air within the hot air supplying pipe 620. Hence, the fan 612 is driven by the controller for guiding the heated air along the hot air supplying pipe 620.

High temperature air flowing like that, in other words hot air, is discharged into the keeping part 220 of the cabinet dryer 200 to dry the laundry within the keeping part 220.

Once the drying cycle is completed through the above series of processes, the controller 300 performs a refreshing cycle for the laundry within the keeping part 220 (S180).

The refreshing cycle is performed through controlling the steam generating part 710.

That is, the heating element 712 is operated by the controller 300 for evaporating water within the heat radiating part 711 into steam. Hence, the steam is guided by the steam supplying pipe 720 and discharged into the keeping part 220 of the cabinet dryer 200.

Thus, the laundry within the keeping part 220 is refreshed, with being sterilized and wrinkles thereof smoothed out.

In another aspect of the present invention, a second embodiment of the present invention embodies that a washing and/or drying part 100 is a tumble dryer.

The tumble dryer may be an exhaust type dryer which generates hot air by using external air to dry the laundry and discharges the air outside thereof, or a condense type dryer which condenses and heats circulating air to dry the laundry.

Figure 4:
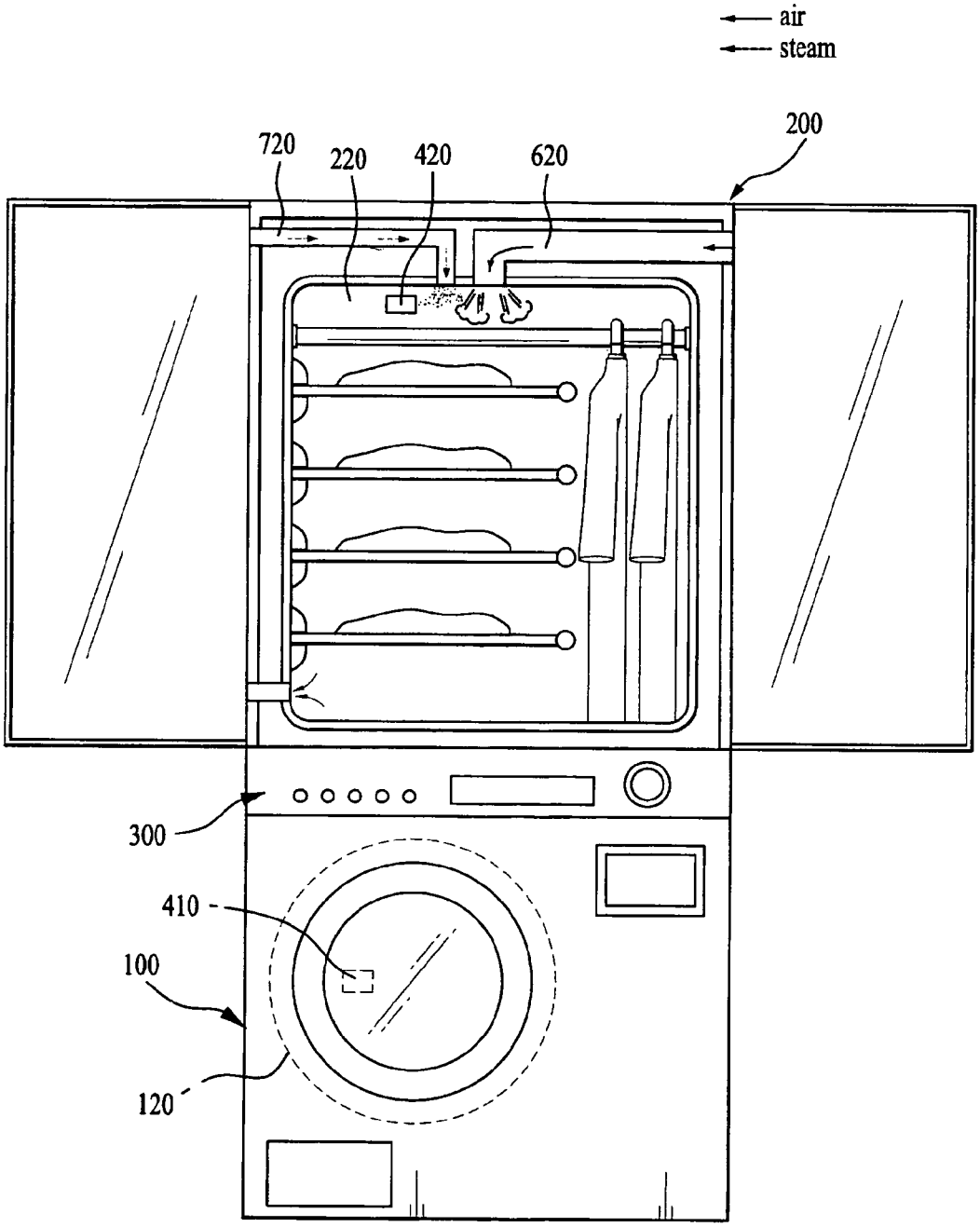
FIG. 4 is a diagram schematically illustrating an exterior of a combination laundry device according to a second embodiment of the present invention.
Figure 5:
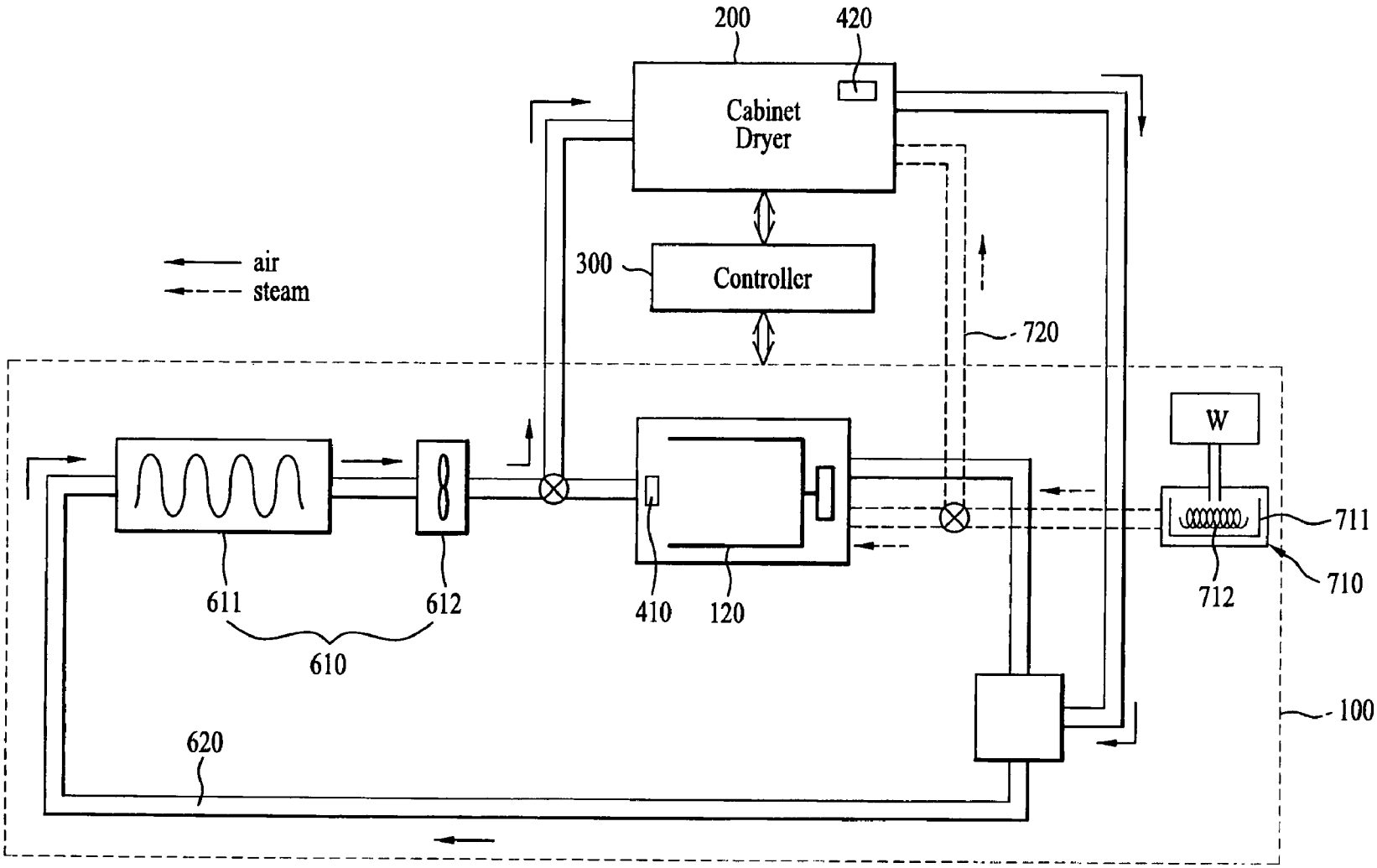
FIG. 5 is a block diagram schematically illustrating the combination laundry device according to the second embodiment of the present invention.

Furthermore, in case the washing and/or drying part 100 is a tumble dryer, a hot air generating part 610 and a steam generating part 710 are preferably provided in the washing and/or drying part 100, as shown in FIGS. 4 and 5. Also, a hot air supplying pipe 620 and a steam supplying pipe 720 are in communication with an inside of a keeping part 220 within the cabinet dryer 200.

Referring to a flow chart of FIG. 6, an operation control method of the combination laundry device according to the second embodiment of the present invention will be described.

First, a controller 300 controls a reading part 410 to acquire information relating to drying from each information tag 500 of the laundry loaded into the drum 120, and the acquired information is stored (S210).

The information relating to drying includes at least one of a kind of each laundry, a quantity of each laundry according to each kind, a preferred drying temperature and a preferred drying time period.

Alternatively, the information acquired by the reading part 410 may further include directions for drying.

Hence, the controller 300 receives the information acquired by the reading part 410, and sets up each process of a drying cycle performed in the washing and/or drying part 100 and each process of a drying cycle performed in the cabinet dryer 200 (S220).

At that time, each of the processes is preset based on at least one of categories, one category including a drying temperature and a drying time period for a drying cycle in the washing and/or drying part 100, and the other category including a drying temperature and a drying time period for a drying cycle in the cabinet dryer 200.

For example, once the kind of the laundry loaded into the drum 120 is identified as wool, a drying cycle within the washing and/or drying part 100 is set to be performed at a low drying temperature and for a long period of time, and a drying cycle within the cabinet dryer 200 is set to be performed at a lower temperature than the drying cycle of the washing and/or drying part 100.

That is why the cabinet dryer 200 is operated not for drying the laundry, but for keeping the laundry for a long period of time.

Hence, once setting each process of each drying cycle, the controller 300 controls the washing and/or drying part 100 to perform a drying cycle for the laundry loaded into the drum, based on the order of the set processes of each cycle (S230).

When the drying cycle described above is completed, the dried laundry is taken out of the washing and/or drying part 100. Hence, after loading the laundry into the keeping part 220 of the cabinet dryer 200, another drying cycle and a refreshing cycle are performed by controlling the cabinet dryer 200 (S270 and S280).

The drying cycle is performed by controlling a hot air generating part 610, and the refreshing cycle is performed by controlling a steam generating part 710.

Figure 6:
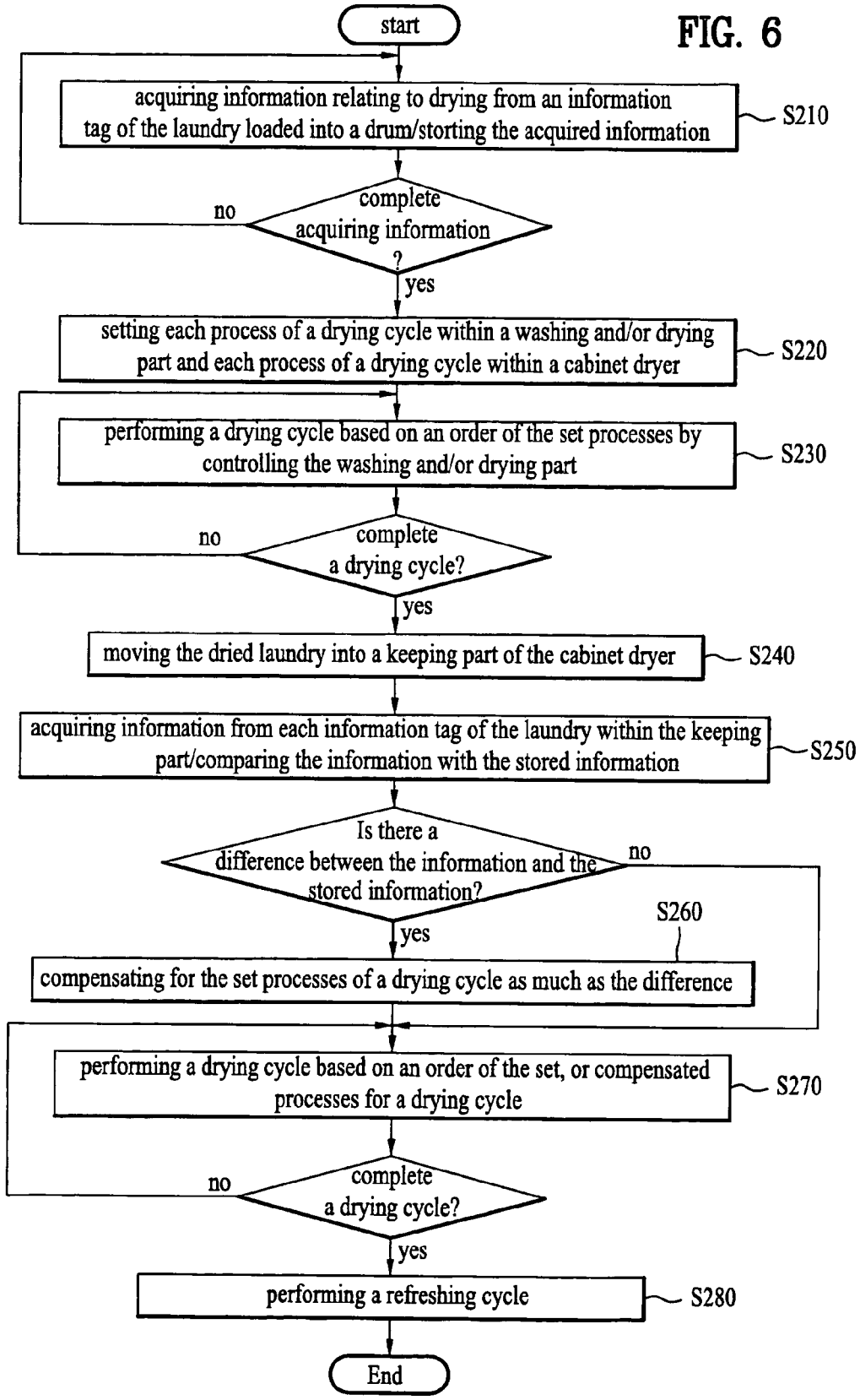
FIG. 6 is a flow chart schematically illustrating controlling processes of the combination laundry device according to the second embodiment of the present invention.

Preferably, like steps of S250 and S260 shown in FIG. 6, the laundry within the keeping part 220 is re-identified by using an auxiliary reading part 420, and once there is an information difference, the difference is made up for.

Thus, the drying and refreshing cycle is completed by the processes described above.

In another aspect of the present invention, a third embodiment embodies that a washing and/or drying part 100 is a washing machine with a drying function.

In that case, preferably a hot air generating part 610 and a steam generating part 710 are provided in the washing and/or drying part 100, and the operation control method thereof is the same as that of the first embodiment.

Preferably, while operating control processes according to the first embodiment, a washing cycle is completed and then a rough drying cycle for the laundry within the washing and/or drying part 100 is performed.

At that time, when the rough drying cycle is performed, a drum 120 constantly rotates and supplies hot air therein to dry the laundry. Thereby, the rough drying cycle may have more smooth drying efficiency than a drying cycle within the cabinet dryer 200.

In that case, it is preferred but not necessary that the cabinet dryer 200 is controlled to perform a drying and refreshing cycle not for drying the laundry, but for keeping the laundry for a long period of time.

Therefore, although a washing machine and a cabinet dryer, a tumble dryer and a cabinet dryer, and a washing machine with a drying function and a cabinet dryer are provided as one body, it is possible for the above mechanisms to communicate each other. Thereby, collective unification control is possible.

That is, the present invention has an advantageous effect that the user need not put each mechanism into operation for washing and drying the laundry every time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A combination laundry device comprising:

a washing and/or drying part having a drum for performing a washing and a drying cycle for the laundry each having an information tag memorizing information relating to washing and/or drying conditions;

a cabinet dryer combined with the washing and/or drying part for performing a drying or a refreshing cycle, or keeping the laundry therein;

a reading part for acquiring information memorized in each information tag of the laundry; the reading part provided in the washing and/or drying part, and an auxiliary reading part provided in the cabinet dryer for acquiring information memorized in each information tag of the laundry within a keeping part, and a controller provided in at least one of the washing and/or drying part and the cabinet dryer for acquiring information of the entire laundry loaded into the drum and the keeping part from the reading part and the auxiliary reading part respectively, and for controlling the washing and/or drying part and the cabinet dryer by selectively setting operation conditions of the washing and/or drying part and the cabinet dryer, wherein the controller compares the information acquired from the reading part with the information acquired from the auxiliary reading part, and compensates for operating conditions of the cabinet dryer as much as a difference when there is the difference between the information acquired from the reading part and the information acquired from the auxiliary reading part.

2. The combination laundry device of claim 1, wherein the information tag is a RFID tag and the reading part is a RFID reader which receives information from the RFID tag, interchanging signals with the RFID tag or recording new information in said RFID tag.

3. The combination laundry device of claim 1, wherein the reading part is provided at a portion of the washing and/or drying part, where the laundry is loaded.

4. The combination laundry device of claim 1, wherein the washing and/or drying part is a washing machine performing only a washing cycle for the laundry.

5. The combination laundry device of claim 1, wherein the washing and/or drying part is a washing machine with a drying function performing a washing and a drying cycle for the laundry.

6. The combination laundry device of claim 1, wherein the washing and/or drying part is a tumble dryer performing only a drying cycle for the laundry.

7. The combination laundry device of claim 1, wherein a hot air generating part is further provided in at least one of the washing and/or drying part and the cabinet dryer for generating hot air to supply the hot air into the washing and/or drying part and the cabinet dryer.

8. The combination laundry device of claim 7, wherein the hot air generating part is connected with the drum of the washing and/or drying part, and/or the keeping part of the cabinet dryer by a hot air supplying pipe.

9. The combination laundry device of claim 8, wherein the hot air generating part comprises a drying heater for heating air within the hot air supplying pipe.

10. The combination laundry device of claim 9, wherein the hot air generating part further comprises a fan for ventilating air within the hot air supplying pipe.

11. The combination laundry device of claim 1, wherein a steam generating part is further provided in at least one of the washing and/or drying part and the cabinet dryer for generating steam.

12. The combination laundry device of claim 11, wherein the steam generating part is connected with the drum of the washing and/or drying part, and/or the keeping part of the cabinet dryer by a steam generating pipe.

13. The combination laundry device of claim 11, wherein the steam generating part comprises a heat radiating part having space for storing supplied water temporarily, and a heating element provided within the heat radiating part for heating and evaporating the supplied water into steam.

14. A method of combination laundry device, comprising:

a first step of acquiring information relating to washing and/or drying conditions from each information tag of the laundry loaded into a drum of a washing and/or drying part;

a second step of setting each process of each cycle for washing and/or drying the laundry based on the acquired information; and a third step of performing a washing and/or drying cycle based on an order of the set processes by controlling the washing and/or drying part, and/or a cabinet dryer, wherein the third comprises a step of acquiring information of the laundry from each information tag within a keeping part of the cabinet dryer, and a comparing the information with the information acquired in the first step, wherein in case othere is a difference between the information and the information acquired in the first step, the third step further comprises a step of compensating for the operating conditions of the cabinet dryer as much as the difference.

15. The method of the combination laundry device of claim 14, wherein the information relating to washing and/or drying conditions acquired from each information tag of the laundry includes at least one of a kind of the laundry, a quantity of each kind, a preferred washing temperature, a dehydrating speed, a kind of detergent, a washing water level, a drying temperature and a drying time period, and additional directions.

16. The method of the combination laundry device of claim 14, wherein each process of each cycle operation within the washing and/or drying part is set and operated based in at least one category of a washing time period, a washing temperature, a dehydrating speed, a drying temperature and a drying time period.

17. The method of the combination laundry device of claim 14, wherein the third step further comprises step of:

performing a washing and/or drying cycle for the laundry loaded into the drum based on the order of the set processes by controlling the washing and/or drying part;

moving the washed and/or dried laundry within the keeping part of the cabinet dryer; and performing a drying and/or a refreshing cycle for the laundry within the keeping part by controlling the cabinet dryer based on the order of the set processes.

18. The method of the combination laundry device of claim 14, wherein the step of compensating for the operating conditions is compensating for at least one of a drying temperature and a drying time period as much as the difference.

* * * * *